US006483241B1

(12) United States Patent
Stockwald

(10) Patent No.: US 6,483,241 B1
(45) Date of Patent: Nov. 19, 2002

(54) MERCURY-FREE METAL HALIDE LAMP WITH A FILL CONTAINING HALIDES OF HAFNIUM OR ZIRCONIUM

(75) Inventor: Klaus Stockwald, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/455,193

(22) Filed: Dec. 6, 1999

(30) Foreign Application Priority Data

Dec. 14, 1998 (DE) ..... 198 57 585

(51) Int. Cl.[7] ..... H01J 61/18
(52) U.S. Cl. ..... 313/638; 313/643
(58) Field of Search ..... 313/637, 638, 313/639, 642, 643, 571

(56) References Cited

U.S. PATENT DOCUMENTS 6,069,456 A * 5/2000 Fromm et al. ..... 313/637

FOREIGN PATENT DOCUMENTS

EP 0627759 5/1994 ..... H01J/61/12

* cited by examiner

*Primary Examiner*—Nimeshkumar D. Patel
*Assistant Examiner*—Thelma Sheree Clove
(74) *Attorney, Agent, or Firm*—William H. McNeill

(57) ABSTRACT

A mercury-free metal halide lamp with a light efficiency of at least 70 Im/W and a color rendering index of at least 80 has a ceramic discharge vessel, into which electrodes are introduced in a vacuum-tight manner. The fill comprises the following components: an inert gas which acts as buffer gas, a compound of a halogen X with at least one of the metals hafnium and/or zirconium (referred to below as metal halide HZM), this halide being referred to below as HZH for short, HZH simultaneously performing tasks of voltage gradient formation and of promoting the cycle, a light generator comprising at least a further metal halide, at least one further metal halide $MY_n$ which vaporizes readily and is used as voltage gradient generator, the specific molar content of HZH being greater than or equal to 3 $\mu$mol/cm$^3$. In addition, the following relationship applies: $5 \leqq (X+Y)/HZM \leqq 15$, resulting in a lamp service life of more than 5000 hours.

10 Claims, 3 Drawing Sheets

MERCURY-FREE METAL HALIDE LAMP WITH A FILL CONTAINING HALIDES OF HAFNIUM OR ZIRCONIUM

TECHNICAL FIELD

The invention proceeds from a metal halide lamp according to the preamble of claim 1. It deals with mercury-free metal halide lamps, preferably with a ceramic discharge vessel.

PRIOR ART

The use of the halides of hafnium and/or zirconium for metal halide lamps together with mercury as the buffer gas has long been known. EP-B 627 759 has disclosed a metal halide lamp with a high light efficiency which uses mercury as the buffer gas. One exemplary embodiment in that document also shows a mercury-free fill for daylight use, with a color temperature of 5350 K, using $HfBr_4$ as the metal halide and with an addition of elemental tin. In this case, xenon (cold filling pressure 1 bar) takes over the role of the buffer gas. However, these lamps have enormously high restarting peaks of about 600 V and therefore can only be operated with complex circuit engineering. In addition, the service lives of the lamps described in this document lie between a few hours and, at best, 2100 hours. These lamps are therefore unsuitable for general-purpose illumination.

DESCRIPTION OF THE INVENTION

The object of the present invention is to provide a metal halide lamp according to the preamble of claim 1 which does not contain any mercury and is still able to achieve a long service life of greater than 5000 hours.

This object is achieved by means of the characterizing features of claim 1. Particularly advantageous configurations are given in the dependent claims.

The invention firstly provides Hg-free metal halide lamps, in particular with a ceramic discharge vessel, with properties similar to those which are already known for metal halide lamps with a discharge vessel made from quartz glass and Hg-containing fill, i.e. a high light efficiency of at least 70 Im/W and a high color rendering index Ra of at least 80, preferably for low outputs of up to 250 W. In this case, the service life is at least 5000 hours. The light color lies in the range from warm white to daylight white. Operation is advantageously on an electronic ballast.

For the first time, it has now become possible to achieve excellent maintenance of the light flux. Blackening of the wall of the discharge vessel is substantially avoided. This results from an optimization of the tungsten cycle which is no longer, as is generally known, controlled only by means of the halogens in the fill, which are usually present in the form of metal halides. Surprisingly, it has emerged that the addition of the metals Hf and/or Zr ("HZM") as halides ("HZH"), while maintaining certain concentration relationships, improves the efficiency of the cycle decisively and thus allows long service lives even with Hg-free fills.

The discharge vessel may be a quartz glass bulb. Preference is given to a ceramic discharge vessel which may be tubular or bulged.

One condition for a cycle which proceeds particularly efficiently is a specific minimum concentration of metals which are active in the cycle ("HZM"), primarily Hf and Zr. They are present in the form of their halides, abbreviated as halides of hafnium and/or zirconium ("HZH"). Suitable halogens X are bromine, chlorine and iodine. The specific quantity of HZH in the discharge vessel must be at least 3 $\mu$mol/cm$^3$:

$$HZH \geqq 3\ \mu\text{mol/cm}^3.$$

It is a fortunate state of affairs that these two metals at the same time have pronounced properties relating to the formation of a voltage gradient, so that they are able to partially replace the mercury in this respect. However, it is necessary for at least one further metal halide to be added to the fill as a voltage generator, in order to achieve as good a match as possible to the voltage gradient of mercury.

Metal halides MYn which vaporize readily and where Y is a halogen selected from bromine, chlorine and iodine are suitable for this purpose. These readily vaporizable metal halides are generally present in completely vaporized form, since they have a boiling point or a sublimation point of at most 1100 C. This temperature is reached at the vessel wall primarily when operating ceramic discharge vessels. Furthermore, elemental metals are suitable additions in order to make the cycle particularly effective and, in this way, to ensure a long service life of more than 6000 hours. Suitable elemental metals N are those which, together with free halogens, are able to form metal halides or metal halide complexes which vaporize readily at typical wall temperatures of around 1000° to 1100° C. The following metals are suitable in elemental form or as metal halides: Al, Bi, In, Mg, Sc, Sn, Tl, Zn, Sb, Ga.

The sum of the amount of halogen X which is bonded in the Hf/Zr halides and the amount of halogen Y which is bonded in the added readily vaporizable metal halides $MY_n$ (in each case in $\mu$mol), based on the metal content (HZM) which is bonded in the Hf/Zr content, must maintain a specific range in order to ensure an efficient cycle:

$$5 \geqq (X+Y)/HZM \geqq 15.$$

A value of between 8 and 13 is preferred. Without the addition of further metal halides to the metals HZM (i.e. when using elemental metals as in the prior art), this ratio would be equal to 4.

In particular, it is possible to achieve a longer service life if the total molar metal content "G" of all the voltage gradient generators (inc. Hf and Zr, i.e. HZM) in the fill in relation to only the molar content of the metals Hf and Zr ("HZM") is carefully measured. The metals G (i.e. the sum of M, N and HZM) are present in the fill as virtually completely vaporized metal halides and elemental metals or metals which, with free halogens, are able to form metal halides and metal halide complexes which are virtually completely vaporized at vessel-wall temperatures of typically 1050° C. The G/HZM ratio should be at most 12, i.e.:

$$G/HZM \geqq 12.$$

The natural lower limit, in accordance with the definition, is G/HZM=1.

This upper limit in the ratio between all the metals G which are added as voltage gradient generators and the metals Hf and Zr (HZM) which also affect the cycle results from the fact that if this upper limit in relation to the metals HZM which are active in the cycle is exceeded, there is an excessive concentration of competing metals (M and N) in the vicinity of the electrodes. This impairs the tungsten transport process and ultimately leads to significant worsening in the maintenance.

A further metal which promotes the cycle is titanium. It is therefore suitable as an addition to Hf or Zr, but should only constitute up to 50 mol % of the total amount of HZM.

In a particularly preferred embodiment, there is an excess of the total molar halogen content X+Y (normally bonded in the readily vaporizable halide compounds). The sum of X+Y is at least 1.4 times the total molar metal content G which is bonded in the readily vaporizable compounds $MY_n$ and metals N together, i.e.:

$$(X+Y)/G \geqq 1.4.$$

Setting this ratio is assisted in particular by the high valency of the HZH (their valency is normally four).

If all the conditions mentioned above are satisfied, the result is an optimum cycle which leads to service lives of over 6000 hours.

The most suitable operating mode is a square-wave current injection with a high edge gradient (i.e. a duration of the voltage change during a polarity change between two square-wave pulses of different polarity), preferably less than 30 $\mu$s. Operation with constant output is advantageous.

In the case of Hg-free metal halide lamps, metal halides with a high vapor pressure which, at the wall temperatures which are established in the discharge vessel, pass either completely or predominantly into the vapor phase are used to set the voltage gradient in the discharge arc and to set the thermal properties of the lamps. Typical examples of voltage gradient generators in long-life systems which are suitable as an addition to Hf and Zr are halides of In, Zn, Al, Mg. Further suitable additions are the metal halides of Bi, Sc, Sn, Tl, Sb and Ga. These are combined as G (total metals in the voltage gradient generators).

However, the voltage gradient generators, primarily the HZM, are less suitable for light generation. For this reason, it is necessary to add at least one further metal halide, i.e. a compound which has at least one intensive line in the visible spectral range between 380 and 780 nm, to the fill as a light generator. Typical examples of these light generators are halides of the alkali metals (Na) and of the lanthanides. They have a considerably higher boiling point than the voltage gradient generators and accordingly have a much lower vapor pressure.

With the fill according to the invention, it is possible to achieve a maintenance of more than 80% of the light flux after an operating period of 5000 h, based on the 100 h value. The initial efficacy after 100 h is at least 70 Im/W. A warm white light color with $T_n$=3500 K with a color locus close to the Planckian locus is typical. A preferred application area is interior illumination with color temperatures of between about 2800 and 4200 K, with low wattages of between 35 W and 150 W being the main aim. Good color rendering (better than 80) is particularly difficult to achieve, especially at low color temperatures. The actual detailed performance is dependent on the selection of the voltage generators added and on the mixture of the constituents included in the fill as light generators.

This maintenance performance can be explained by a significantly improved W cycle, with the direct participation of Hf and Zr in the gas phase. Examinations of discharge vessels which satisfy the inventive condition with regard to the HZH content do not reveal any deposits of solid tungsten in the discharge vessel, which corresponds to a negligible blackening of the discharge vessel over the service life of the lamp.

Taking into account the reactivity of the other fill constituents with the wall materials used, the fill compositions according to the invention can be used both in quartz glass vessels and in ceramic vessels. However, translucent polycrystalline aluminum oxide or similar translucent polycrystalline ceramic materials (such as AlON, AlN, etc.) or monocrystalline sapphire are preferably used as the wall material rather than quartz glass, due to their greater ability to withstand thermal loads. These materials exhibit considerably lower reactivity with respect to the fill constituents at relatively high operating temperatures.

The invention can be used both for applications in general-purpose illumination and for the sectors of automotive illumination and photo-optics. In these applications, high-efficiency Hg-free lamps with constant maintenance of the light flux and constancy of the remaining light data over the entire service life are of great importance. In this case, the application range extends to outputs from about 20 W to more than 250 W.

The lamp systems according to the invention are advantageously employed in an illumination system using square-wave or HF ballasts.

In detail, the fill, in addition to an inert gas which acts as buffer gas (Ar, Kr, Xe with a cold filling pressure of typically 0.1 to 1 bar, under certain circumstances up to 10 bar), should contain at least Hf and/or Zr halides, for example $HfX_4$ (X=I, Br, Cl), since these substances form the basis for a functioning W cycle with a Hg-free fill.

In addition, the fill contains at least one additional voltage generator serving to further increase the voltage gradient and to protect against premature melt-back of the electrodes, since the electrodes are subjected to considerable loads by the presence of Hf or Zr, owing to their high solubility in tungsten. Suitable additional voltage generators are metal halides which generate a high operating vapor pressure at a typical wall temperature (approx. 900 to 1 100° C.). A typical partial pressure of the voltage generators in operation is more than 0.5 bar. A measure which has a similar effect is that of increasing the cold filling pressure of the starting gas (usually xenon) which acts as a buffer gas to more than 1 bar, in particular up to 10 bar.

Furthermore, the fill contains other metal halides which are difficult to vaporize. They act as light generators and stabilize the arc. Halides of the rare-earth metals (lanthanides) and/or of the alkali metals, in particular of Na, Pr, Nd, La, Dy, Ho, Tm, are suitable.

The absolute fill quantity of the Hf/Zr halide mixture must exceed a lower limit, so that an extremely stable chemical cycle can proceed in the lamp:

$$HZH \geqq 3\ \mu\text{mol/cm}^3.$$

If this lower limit is not reached, the maintenance performance is noticeably impaired and the W cycle is not effective enough. A value of between 4 and 6 $\mu$mol/cm$^3$ is preferred. If the value 6 $\mu$mol/cm$^3$ is exceeded, under certain circumstances the high level of HZH and the high solubility of the HZM in tungsten may cause the electrode to melt at the tip, which is subjected to high loads.

At least one further metal halide is added to the HZM. This addition is in the form of a light generator, i.e. of at least one further readily vaporizable metal halide $MY_n$ (where Y=I, Br, Cl; and n=1 to 5). In addition, further elemental metals N (by way of example, M, N=Zn, Mg, Sn, In, Tl, Al, Sb) may be added, which further elemental metals, with free halogens, are able to form metal halides with a high vapor pressure at the wall temperatures which typically arise in operation (for example 1000° C.). Thus, the combination of the abovementioned substances together with the Hf/Zr halides HZH provides the major fraction of the total vapor pressure in the lamp, apart from the buffer gas which has been introduced. The amount of the fill which is made up of the metal content added to HZM (including HZM) in relation to the HZM metal contents which are only bonded in the Hf/Zr halides should preferably not exceed a critical value of 12. Therefore, where G=M+N+HZM, the following ratio B applies:

$$B=G/HZM\leqq 12.$$

The ratio B is preferably between 3.3 and 7.5. Without the addition of additional metal halides to the halides of the HZM, the value of B would be 1.

In the event of the upper limit B=12 being exceeded, the efficacy of the W—Hf—Zr cycle is noticeably impaired by the competition from the other types of metals. The service life falls and the maintenance of the lamp during an operating time of 5000 h worsens.

The ratio D of the sum of the amount of halogen X which is bonded in HZH (predominantly $HfX_4$ and/or $ZrX_4$ and the amount of halogen Y bonded in the added, readily vaporizable metal halide content, on the one hand, i.e. (X+Y), to the sum of all the metal contents (G=M+N+HZM) of the substances acting as voltage generators Hf/Zr-$X_4$ and $MY_n$ and N (in each case in $\mu$mol) should preferably reach a minimum value:

$$D=(X+Y)/(HZM+M+N)\leqq 1.4.$$

This ratio is preferably higher than 1.46. Without the addition of additional metals and metal halides to the HZM, this ratio would be equal to four.

FIGURES

The invention is to be explained in more detail below with reference to a plurality of exemplary embodiments. In the drawing:

FIG. 1 shows a metal halide lamp, partially in section;

FIG. 2 shows an illustration of the way in which the light flux is maintained for a preferred fill; and FIG. 3 shows a further exemplary embodiment of a metal halide lamp.

Figure 1:
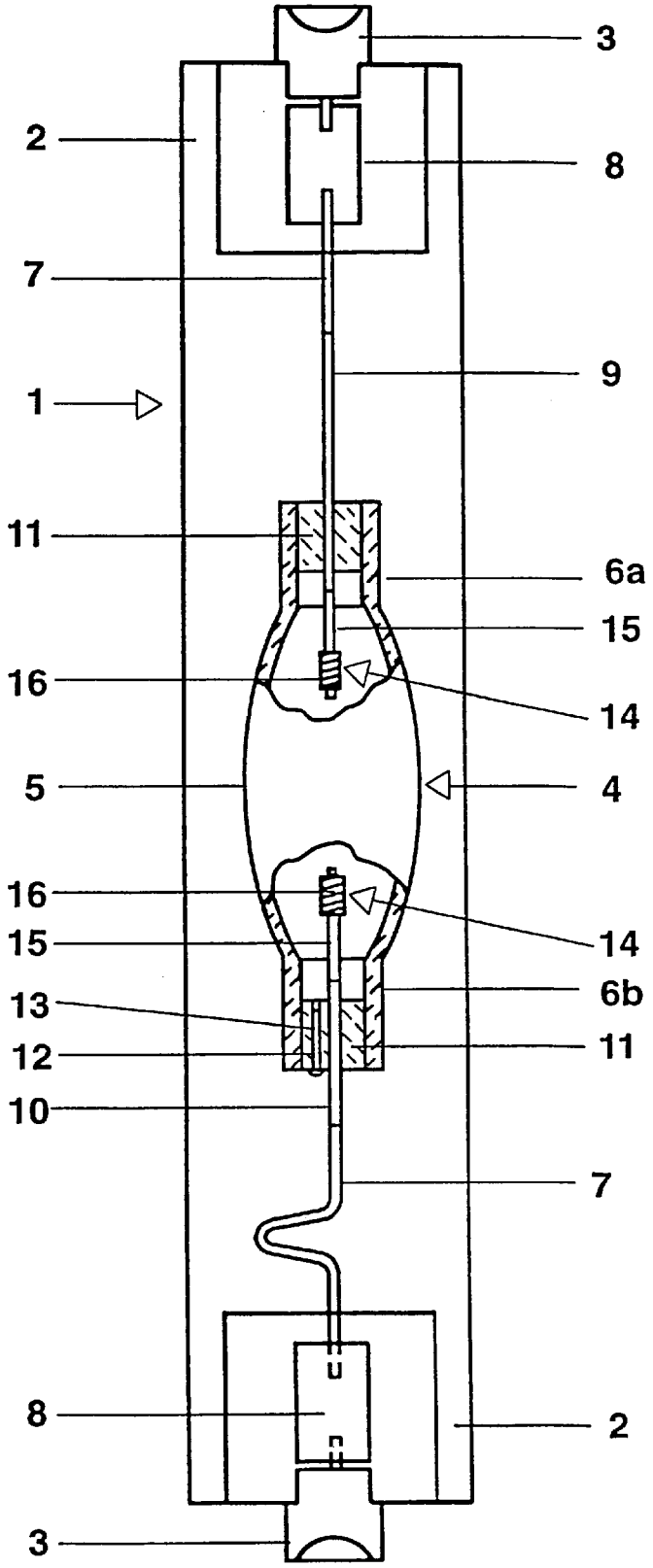
FIG. 1 diagrammatically depicts a metal halide lamp with an output of 70 W. It comprises a cylindrical outer bulb 1 which defines a lamp axis, is made from quartz glass and is pinched (2) and capped (3) on two sides. The axially arranged discharge vessel (4), which is made from $Al_2O_3$ ceramic, is bulged in the center 5 and has two cylindrical ends 6*a* and 6*b*. However, it may also be cylindrical, with elongate capillary tubes as stoppers, as is known, for example, from EP-A-587.238. The discharge vessel is held in the outer bulb 1 by means of two supply conductors 7 which are connected to the cap parts 3 via foils 8. The supply conductors 7, one of which is a molybdenum strip in order to compensate for substantial differences in expansion, are welded to lead-throughs 9, 10 which are each fitted inside an end stopper 11 at the end of the discharge vessel.

The lead-throughs 9–10 are, for example, molybdenum pins. Both lead-throughs 9, 10 project beyond the stopper 11 on both sides and, on the discharge side, hold electrodes 14 comprising an electrode stem 15 made from tungsten and a filament 16 which has been pushed onto the discharge-side end. Each lead-through 9, 10 is butt-welded to the electrode stem 15 and to the outer supply conductor 7.

The end stoppers 11 essentially comprise a cermet which is known per se, with the ceramic component $Al_2O_3$ and the metal component tungsten or molybdenum. Moreover, an axially parallel hole 12 is provided in the stopper 11 at the second end 6*b*, which hole is used to evacuate and fill the discharge vessel in a manner known per se. Following filling, this hole 12 is closed by means of a pin 13, which is also known in the specialist jargon as a stopper, or by means of fused ceramic.

The fill in the discharge vessel comprises an inert firing gas/buffer gas, in this case argon with a cold filling pressure of 150 mbar, and various additions of metal halides. A content of at least 3 $\mu$mol/cm$^3$ HZH is essential in this context.

The fill contains a total of up to three voltage gradient generators, a suitably selected mixture as light generator and, if appropriate, further additives. In particular, TlI has proven to be a suitable additional voltage gradient generator, if appropriate in combination with further voltage gradient generators. Moreover, TlI provides a contribution within the visible spectral range.

Table 1 shows a number of fills, with the voltage gradient generators and light generators shown separately from one another. The result is light effeciencies of between 70 and 77 Im/W (100 h value) combined with good color rendering between $R_a$=84 and 88. Overall, suitable halogens are not only bromine and iodine, but also chlorine. The color temperatures of these systems are between 3300 and 4000 K.

TABLE 1

| HZM | HZH | Level of HZH ($\mu$mol/cm$^3$) | Additional voltage gradient generators | Molar ratio G/HZM | Molar ratio (X + Y)/HZM | Light generators | Ra | Light efficiency (Im/W) |
|---|---|---|---|---|---|---|---|---|
| Hf | $HfBr_4$ | 4.39 | InBr + TlI | 6.2 | 9.2 | NaI, $TmI_3$, $DyI_3$, $HoI_3$ | 84 | 76 |
| Hf | $HfBr_4$ | 4.39 | InBr + $InBr_3$ + TlI | 5.6 | 9.8 | NaI, $TmI_3$ $DyI_3$, $HoI_3$ | 85 | 70 |
| Hf | $HfBr_4$ | 4.33 | $InBr_3$ + TlI | 4.7 | 11.8 | NaI, $TmI_3$, $DyI_3$, $HoI_3$ | 87 | 70 |
| Hf | $HfBr_4$ | 4.39 | $MgI_2$ + TlI | 6.4 | 13.2 | NaI, $TmI_3$, $DyI_3$, $HoI_3$ | 88 | 77 |
| Hf | $HfCl_4$ | 4.40 | InBr + TlI | 5.1 | 8.1 | NaI,$TmI_3$, $DyI_3$, $HoI_3$ | 85 | 73 |
| Zr | $ZrBr_4$ | 4.60 | InBr + TlI | 4.9 | 7.9 | NaI, $TmI_3$, $DyI_3$, $HoI_3$ | 86 | 70 |

A particularly suitable light generator is a mixture comprising sodium as the first component and at least one rare-earth metal as the second component.

A lamp volume of 0.3 cm$^3$ was used for all the fills. The electrode-to-electrode distance is 9 mm. The specific wall load (defined as electric power/internal surface area) varies between 15 and 50 W/cm$^2$. On average, it is 30 W/cm$^2$. The specific electrical power density varies between 100 and 500 $W/cm^3$, and is on average 235 $W/cm^3$.

The lamps were each operated on an electronic ballast with square-wave current injection in a controlled power mode of 70 W with $I_{eff}$<1.8 A.

The service life of these lamps is longer than 5000 hours. Fills containing halides of In or Mg have proven advantageous for a relatively long service life.

Fills which use halides of Hf or Zr, with careful observation of an optimum total quantity of halogens and metals in the fill, exhibit a particularly good maintenance performance with regard to the light flux.

Figure 2:
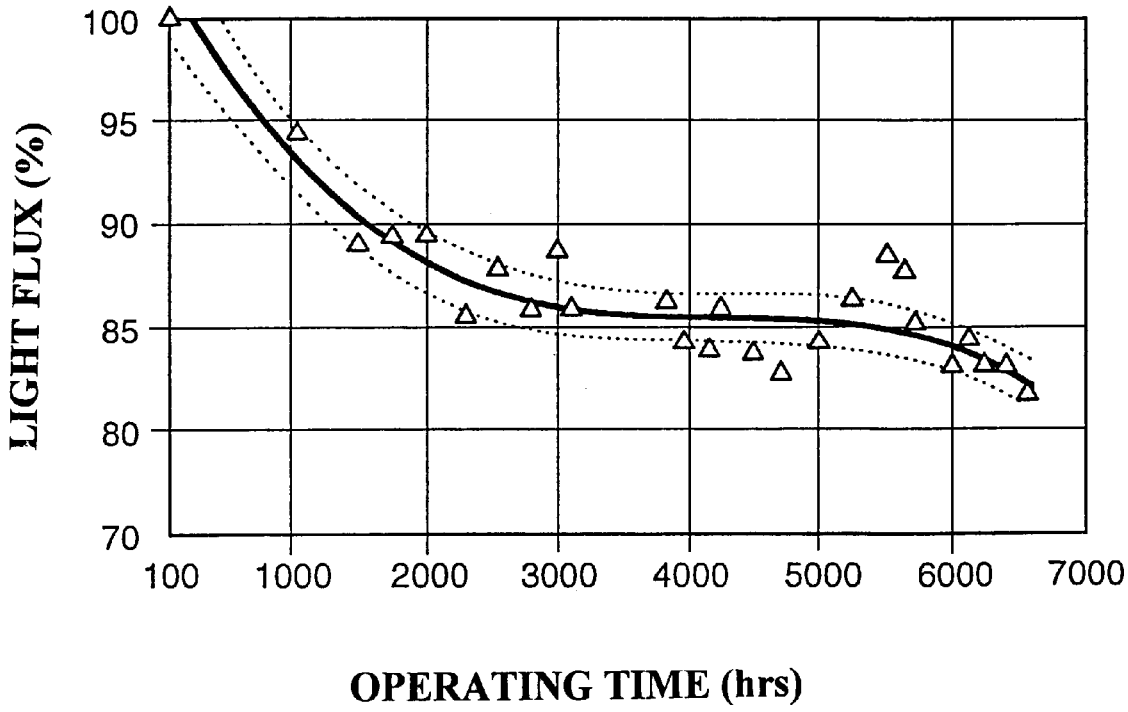

FIG. 2 shows an example of the good maintenance of the light flux (in Im) over the operating period (in hours). The fill is based on $HfBr_4$ (0.7 mg), with the additional voltage generators InBr (0.7 mg), $InBr_3$ (0.3 mg), TlI (0.7 mg) and the additional light generators NaI (2.4 mg), $TmI_3$ (1.5 mg), $DyI_3$ (1.4 mg) and $HoI_3$ (1.5 mg).

Figure 3:
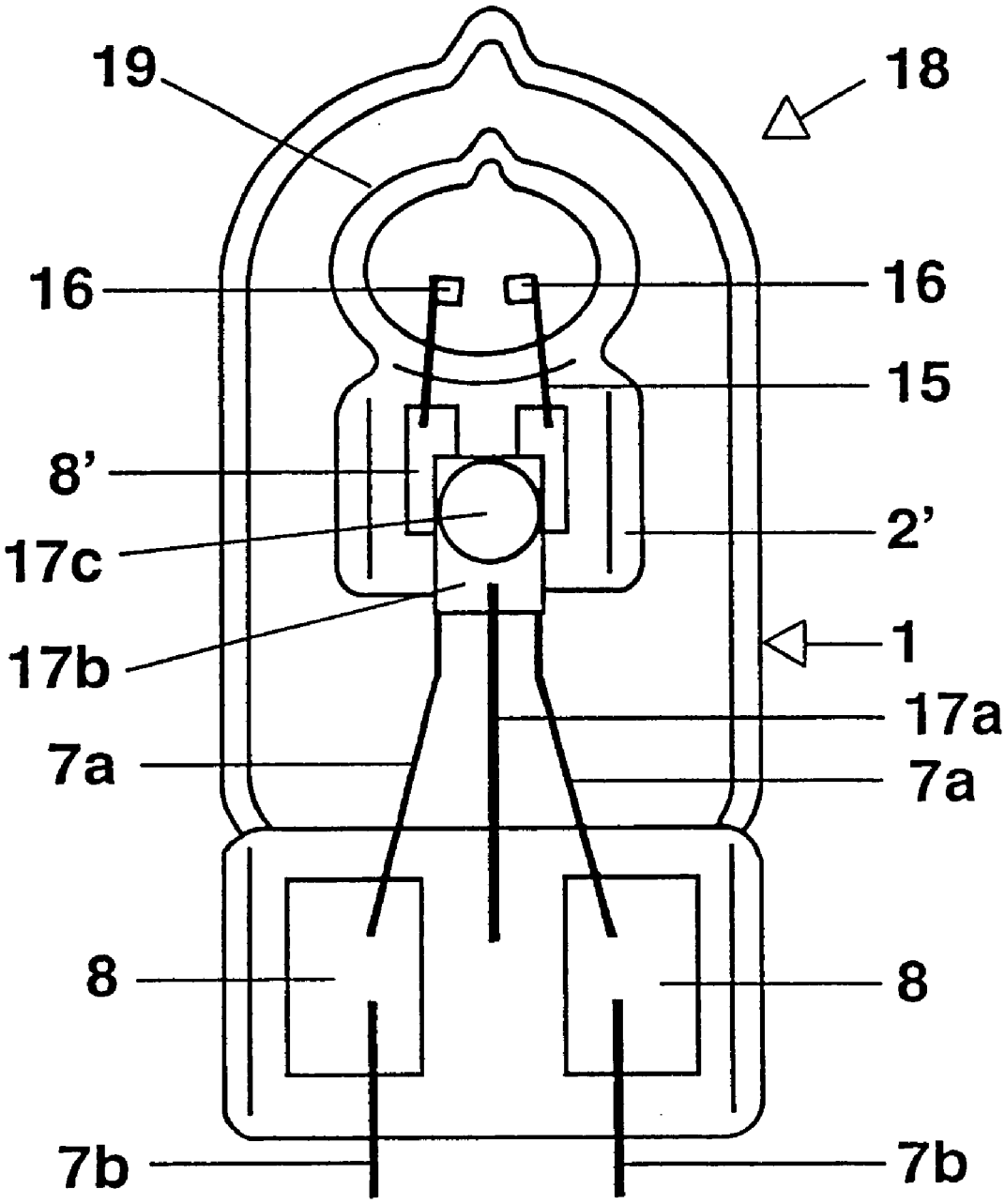

In a further exemplary embodiment (FIG. 3), the lamp is a metal halide lamp 18 with an output of 70 W, which is pinched on one side, the discharge vessel 19 also being a quartz glass bulb which is pinched on one side. Otherwise, identical reference numerals correspond to similar components as in FIG. 1. Moreover, a getter 17 is accommodated in the outer bulb 1.

A very good start-up performance is achieved with an electronic ballast which injects a sufficiently high power to the lamp, (constant wattage operation). The electronic ballast has the significant advantage of avoiding the occurrence of restarting peaks by means of a high edge gradient.

I claim:

1. A mercury-free metal halide lamp with a light efficiency of at least 70 Lm/W and a color rendering index of at least 80, the lamp comprising a discharge vessel into which electrodes are introduced in a vacuum-tight manner, wherein the fill comprises the following components:

an inert gas which acts as buffer gas, at least one compound of a halogen X with at least one metal selected from the group consisting of hafnium and zirconium (referred to below as HZM metals), these halides $HZMX_4$ being referred to below as HZH for short, HZH simultaneously performing tasks of voltage gradient formation and of promoting the cycle, a light generator comprising at least a further metal halide, at least a second further metal M or a compound of a metal M with a halogen Y to form a metal halide $MY_n$, wherein n equals 1–5, which vaporizes at a wall temperature between 1000 and 1100° C. and is used as a voltage gradient generator, the specific molar content of HZH being greater than or equal to 3 $\mu mol/cm^3$, the following molar relationship additionally applying: $5 \leqq (X+Y)/HZM \leqq 15$, resulting in a lamp service life of more than 5000 hours.

2. The mercury-free metal halide lamp as claimed in claim 1, wherein the specific molar content of the HZH is between 4 and 6 $\mu mol/cm^3$.

3. The mercury-free metal halide lamp as claimed in claim 1, wherein the HZM used additionally includes titanium in an amount of up to 50 mol % of the total amount of HZM.

4. The mercury-free metal halide lamp as claimed in claim 1, wherein at least one further elemental metal N is used as the voltage gradient generator.

5. The mercury-free metal halide lamp as claimed in claim 4, wherein the ratio between the level of metals G (in $\mu$mol), where G is formed from one or more of the group consisting of HZM, M and N, and the level of the HZM is less than or equal to 12, and in particular the G/HZM molar ratio is between 3.3 and 8.

6. The mercury-free metal halide lamp as claimed in claim 5, wherein the following molar relationship applies: $(X+Y)/(HZM+M+N) \geqq 1.4$.

7. The mercury-free metal halide lamp as claimed in claim 1, wherein the following molar relationship applies: $8 \leqq (X+Y)/HZM \leqq 13$.

8. The mercury-free metal halide lamp as claimed in claim 1, wherein the discharge vessel is made from ceramic.

9. The mercury-free metal halide lamp as claimed in claim 1, wherein at least one of the following metals or a compound of this metal, in particular a halide thereof, is used as the light generator: Na, Pr, Nd, La, Dy, Ho, Tm.

10. The mercury-free metal halide lamp as claimed in claim 1 or 4, wherein at least one of the following metals or a halide thereof (apart from fluoride) is used as an additional voltage gradient generator: Al, Bi, In, Mg, Sc, Sn, Tl, Zn, Sb, Ga.

* * * * *